US006264434B1

(12) United States Patent
Frank

(10) Patent No.: US 6,264,434 B1
(45) Date of Patent: Jul. 24, 2001

(54) AIR PRESSURE DRIVEN TWO WAY FLUID EVACUATION AND EXPULSION SYSTEM

(76) Inventor: Christian Carl Frank, 8 Narcissus, Mohapac, NY (US) 10541

( * ) Notice: Subject to any disclaimer, the term of this patent is extended or adjusted under 35 U.S.C. 154(b) by 0 days.

(21) Appl. No.: 09/414,683

(22) Filed: Oct. 7, 1999

(51) Int. Cl.[7] ..... F04F 49/03
(52) U.S. Cl. ..... 417/130; 417/34
(58) Field of Search ..... 417/130, 34, 56, 417/39, 41, 120, 126, 131, 134, 138, 145

(56) References Cited

U.S. PATENT DOCUMENTS 1,746,428 * 2/1930 Jennings ..... 417/120
2,400,651 * 5/1946 Marsh ..... 417/120
4,021,147 * 5/1977 Brekke ..... 417/138
4,057,364 * 11/1977 Bratschitsch ..... 417/34
5,749,711 * 5/1998 Park ..... 417/120
5,938,408 * 8/1999 Krichbaum ..... 417/87
6,089,829 * 7/2000 Gestermann et al. ..... 417/118

* cited by examiner

*Primary Examiner*—Teresa Walberg
*Assistant Examiner*—Quang Van
(74) *Attorney, Agent, or Firm*—Goldstein Law Offices, P.C.

(57) ABSTRACT

A fluid evacuation and expulsion system, having a tank having a tank port, a top, a bottom, and an internal volume defined between the top and bottom, also having a pump having a pump inlet and pump outlet, and having a valve assembly having an actuation lever. A conduit is connected to the tank bottom for allowing fluids to enter and leave the tank. The valve assembly is connected to the pump inlet and pump outlet, as well as the tank port and an environment port. The actuation lever of the valve assembly manipulates four ganged valves which allow the system select between an evacuation mode wherein air is pumped from the tank through the tank port to draw fluids into the tank through the conduit, and an expulsion mode wherein air is pumped into the tank to expel fluids from the tank through the conduit.

11 Claims, 3 Drawing Sheets

AIR PRESSURE DRIVEN TWO WAY FLUID EVACUATION AND EXPULSION SYSTEM

BACKGROUND OF THE INVENTION

The invention relates to an air pressure driven two way fluid evacuation and expulsion system. More particularly, the invention relates to a system which employs air pressure to evacuate and store fluids in a storage tank, which is reversible to then expel said fluids from the storage tank under pressure.

A variety of applications require that fluid be removed or evacuated using some type of pumping device. Automotive repair and manufacturing are two examples of fields where pumping of fluids are required on a constant basis. However, often these fluids are too viscous to be pumped using a standard pump. In addition, most pumps require priming, which itself is difficult to achieve when working with viscous liquids.

In addition, once the fluid has been evacuated from a vessel, it is often necessary to return the fluid to the vessel that has been drained, or to simply expel the fluid. Typical pump-out systems require that the operator physically switch hoses, or perform some other operation in order to use the same pump to once again pump the fluid to return it back to the vessel.

Further it is often undesirable to have the fluid actually travel through the pump itself. Certain corrosive materials can have a harmful effect on the pump mechanisms.

While these units may be suitable for the particular purpose employed, or for general use, they would not be as suitable for the purposes of the present invention as disclosed hereafter.

SUMMARY OF THE INVENTION

It is an object of the invention to produce a system which allows fluids to be evacuated from a vessel into a storage tank. Accordingly a system is provided which includes an air pump for creating a low pressure pocket inside the storage tank, and a conduit in communication with the storage tank for drawing fluids into the tank in response to the lower pressure within the storage tank.

It is another object of the invention to provide a system which also expels fluids from the tank. Accordingly, the pump is also capable of pressurizing the tank so as to expel fluids from the tank through the conduit. Advantageously, the conduit extends directly from the bottom of the tank so that all fluid is expelled from the tank.

It is a still further object that the system has safety features to prevent damage to the pump and injury to the user. Accordingly a float actuated shut-off switch will prevent the fluid level from reaching the pump inlet, and a high pressure blow-off valve will prevent the pressure within the tank from exceeding a predetermined safe level.

The invention is a fluid evacuation and expulsion system, having a tank having a tank port, a top, a bottom, and an internal volume defined between the top and bottom, also having a pump having a pump inlet and pump outlet, and having a valve assembly having an actuation lever. A conduit is connected to the tank bottom for allowing fluids to enter and leave the tank. The valve assembly is connected to the pump inlet and pump outlet, as well as the tank port and an environment port. The actuation lever of the valve assembly manipulates four ganged valves which allow the system select between an evacuation mode wherein air is pumped from the tank through the tank port to draw fluids into the tank through the conduit, and an expulsion mode wherein air is pumped into the tank to expel fluids from the tank through the conduit.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
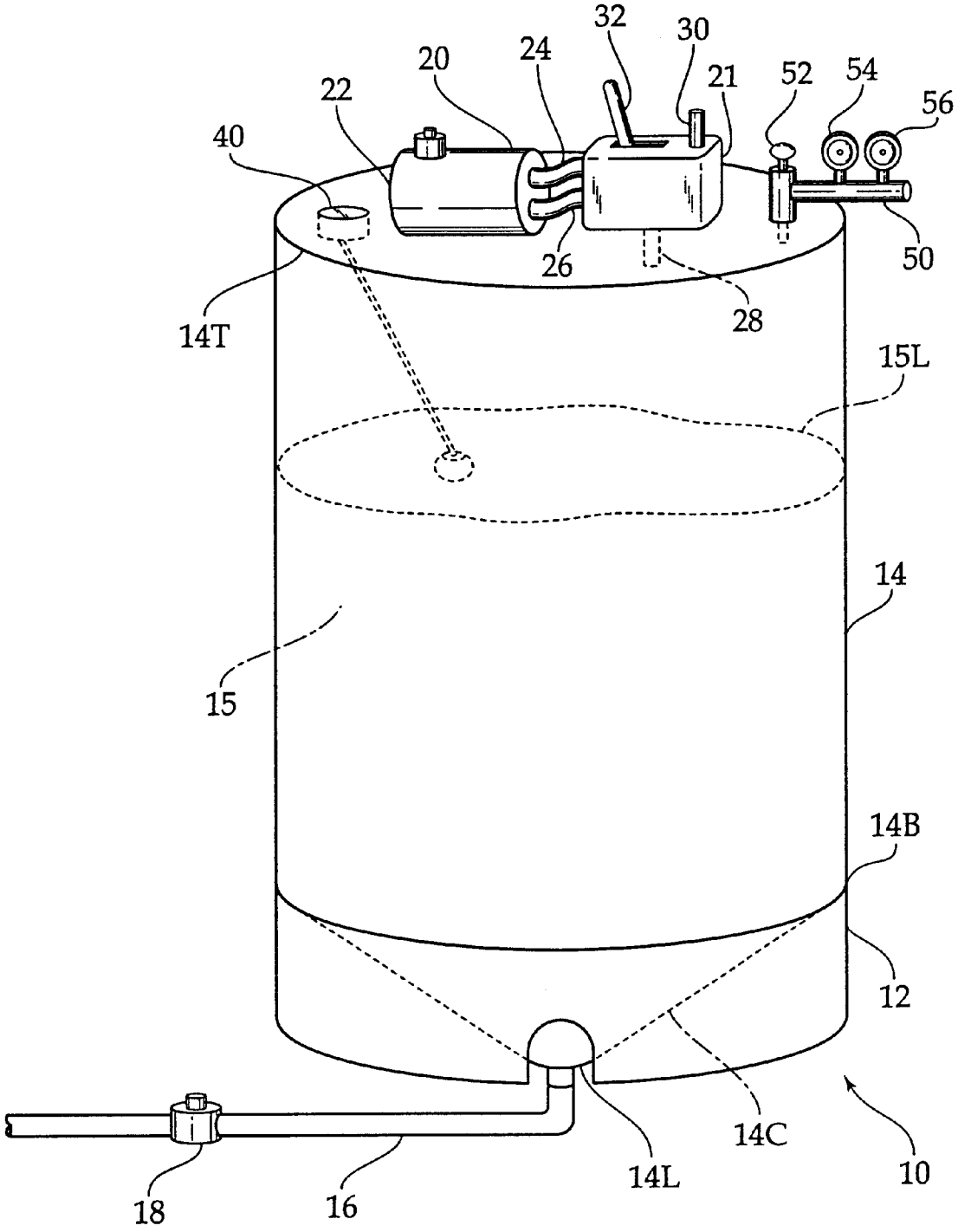
FIG. 1 is a diagrammatic perspective view, illustrating the system of the present invention.

FIG. 1 illustrates a fluid evacuation and expelling system 10, comprising a main housing 12. The housing 12 includes a tank 14 which has a top 14T and a bottom 14B. An internal volume is defined between the top 14T and bottom 14B. The tank has a conical portion 14C at the bottom 14B including a lowest point 14L, for ensuring that any liquid within the tank will drain toward the lowest point 14L.

A conduit 16 is connected to the tank 14 at the lowest point 14L, and is in fluid communication with the internal volume thereof. The conduit 16 has a conduit valve 18 which selectively allows or prevents fluid flow through the conduit 16.

A pump assembly 20 and a valve assembly 21 is located on the housing 12, preferably at the top 14T of the tank 14. The pump assembly 20 includes a pump 22, having an pump inlet 24 and a pump outlet 26. The valve assembly 21 is connected to both the pump inlet 24 and pump outlet 26. The valve assembly 21 in turn has a tank port 28 and an environment port 30. The tank port 28 located at the top 14T of the tank 14, and is in communication with the internal volume of the tank 14. The environment port 30 is in communication with the environment external to the housing 12. The valve assembly 21 also has a valve assembly actuation lever 32 for controlling the operation of the valve assembly 21, for altering the system between an evacuation mode and an expulsion mode in a manner which will be described hereinafter.

As seen in FIG. 1, fluid 15 is present in the tank 15, having a fluid level 15L. A float shutoff switch 40 is mounted in the housing 12, and is positioned to detect when the fluid level 15L is near the top of the tank 14, or more specifically, nears the tank port 28.

An instrument assembly 50 is also located at the top of the tank 14. The instrument assembly 50 is in communication with the internal volume of the tank 14, and includes a blow-off valve 52, a vacuum gauge 54, and a pressure gauge 56. It is possible to combine the vacuum gauge and pressure gauge 56 with a single gauge which is capable of displaying both positive (pressurized) and negative (vacuum) pressures. The blow-off valve 52 is a relief valve which will automatically relieve pressure within the internal volume of the tank when the internal pressure therein exceeds a predetermined limit which for example might be 125 pounds per square inch.

Figures 2, 3:
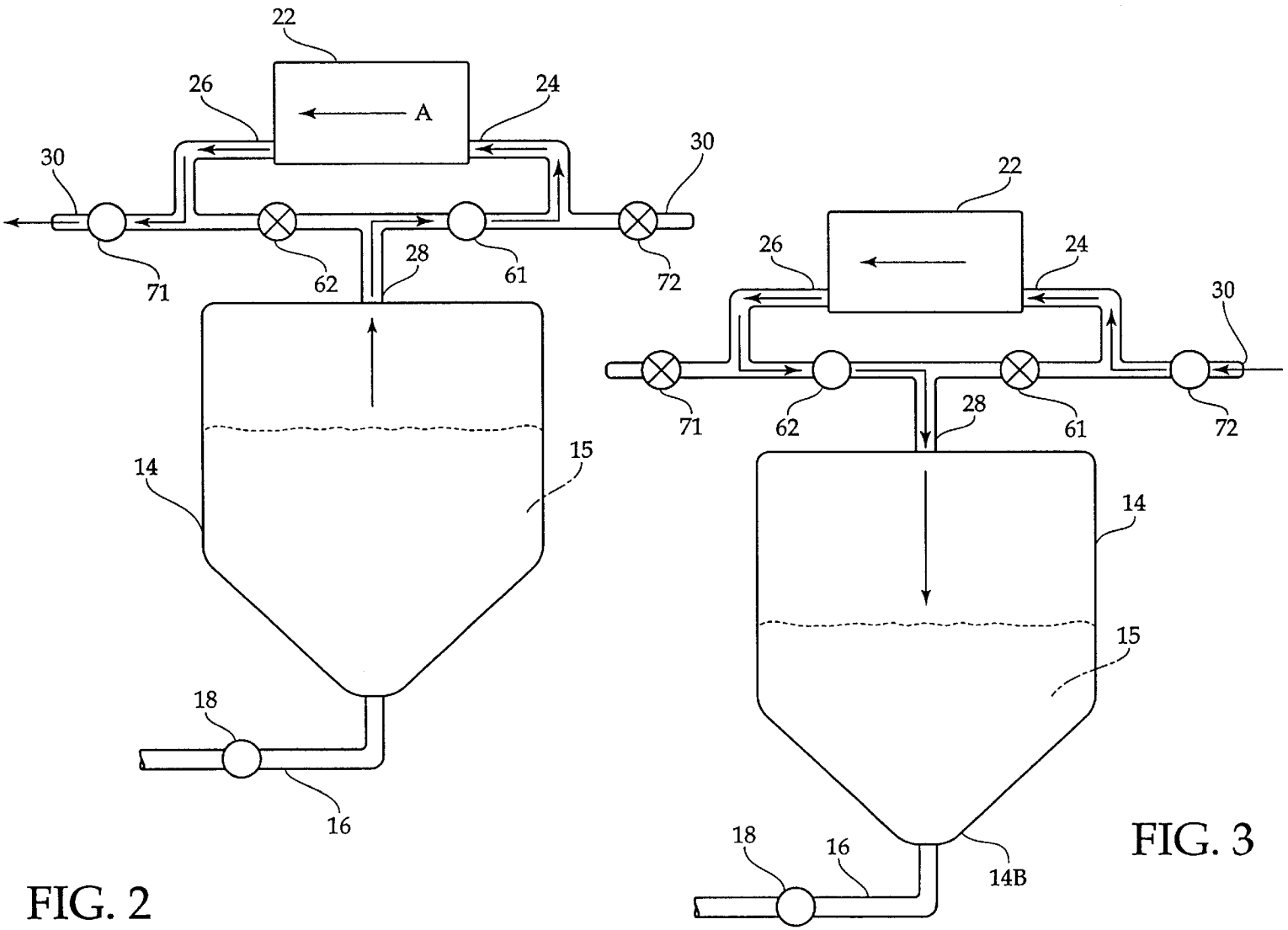
FIG. 2 is a schematic diagram, illustrating the system in evacuation mode, wherein the valves are configured for evacuating fluids.
FIG. 3 is a schematic diagram, illustrating the system in expulsion mode, wherein the valves are configured for expelling fluids.

FIG. 2 schematically illustrates the system in use, in the evacuation mode. The valve assembly comprises four valves which are used to select the mode of the system, which are a forward tank port valve 61, a reverse tank port valve 62, a forward environment port valve 71 and a reverse environment port valve 72. The pump 22 always pumps in one direction as indicated by arrow A: from the pump inlet 24 toward the pump outlet 26.

The valves are configured such that the forward tank port valve 61 is connected between the tank port 28 and the pump inlet 24. The reverse tank port valve 62 is connected between the tank port 28 and the pump outlet 26. The forward environment port valve 71 is connected between the pump outlet 26 and the environment port 30. The reverse environment port valve 72 is connected between the pump inlet 24 and the environment port 30.

In the evacuation mode shown in FIG. 2, the forward tank port valve 61 and the forward environment port valve 71 are open, allowing flow therethrough, while the reverse tank port valve 62 and reverse environment port valve 72 are closed, preventing flow therethrough. Accordingly, as the pump operates, air is drawn from the tank 14 through the tank port 28, through the forward tank port valve 61, through the pump 22, through the forward environment port valve 71, and into the environment surrounding the housing through the environment port 30, creating a low pressure pocket or decreased pressure within the internal volume of the tank. As long as the conduit valve 18 is open, fluid 15 will be drawn through the conduit 16 and into the tank 14.

FIG. 3 shows an expulsion mode, wherein the four valve positions have been altered so that the fluid 15 may be expelled from the tank 14. The tank port forward and reverse valves 61 and 62, and the environment port forward and reverse valves 71 and 72 should all be ganged and operable by the valve assembly actuation lever, so that the position of all of said valves may be altered by a single operation.

As shown by FIG. 3, to accomplish evacuation, the tank port reverse valve 62 is open, as well as the environment port reverse valve 72. However, the forward tank port valve 61 and the forward environment port valve 71 are now closed. Accordingly, air is drawn from the environment port 30 through the reverse environment port valve 72 into the pump 22 through the pump inlet 24, from the pump 22 from the pump outlet 26, through the reverse tank port valve 62, and through the tank port 28 into the interior volume of the tank 14, pressurizing the interior volume of the tank 14. As long as the conduit valve 18 is open, the fluid 15 will be forced out through the conduit 16. Advantageously, because of the shape of the tank bottom 14B, all fluid will be expelled from the bottom 14B of the tank 14.

Figure 4:
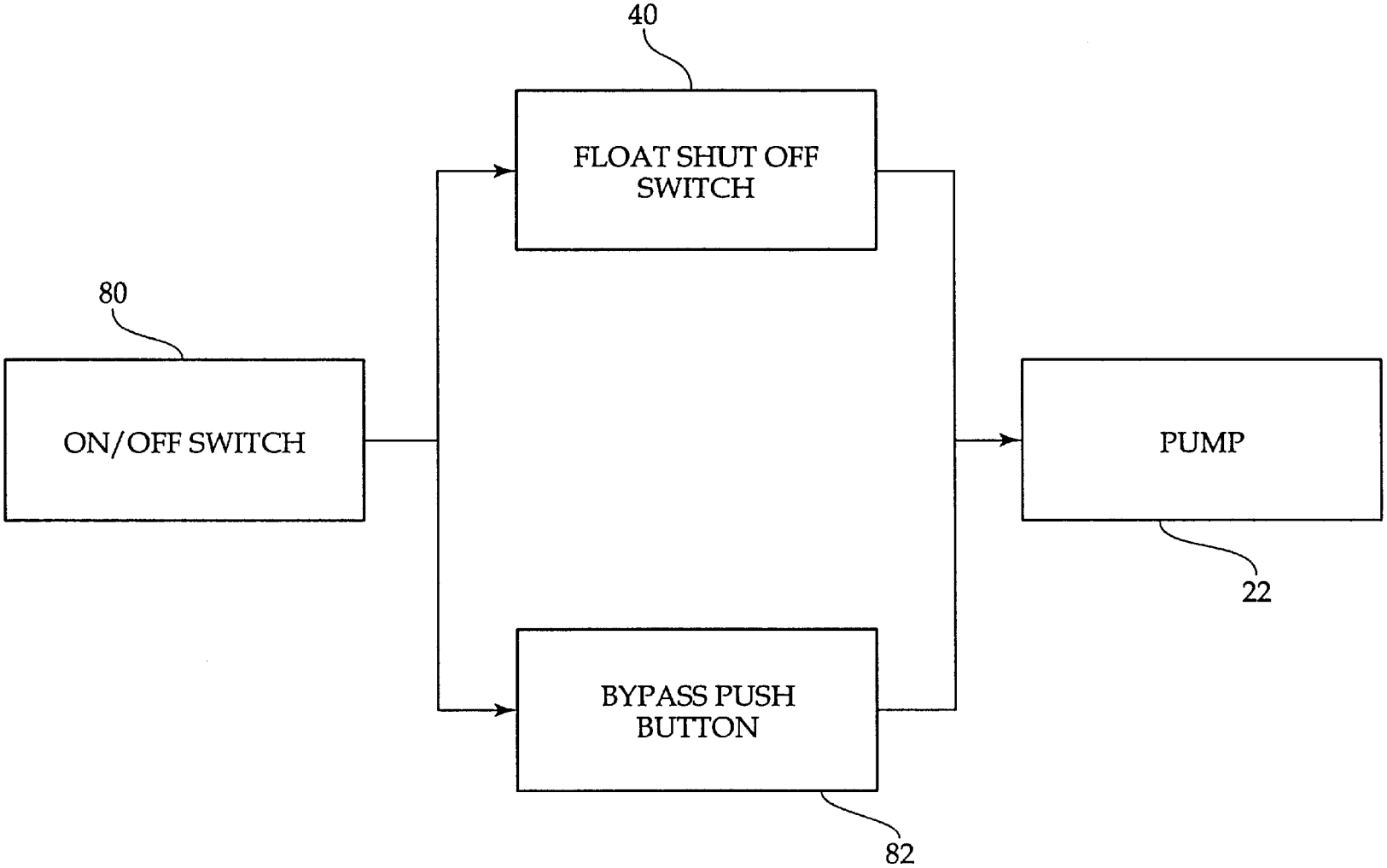
FIG. 4 is a block diagram, illustrating the electrical interconnection of various elements of the system.

FIG. 4 is a block diagram, illustrating the electrical interconnection of various components of the system. Most notably, power is supplied to the pump motor 22 from an on-off switch 80, through the float shut-off switch 40. Accordingly, when the float shut-off switch 40 is open circuited because the fluid level 15L is high, the pump motor 22 will not operate. However, a push-button bypass switch 82 is also provided, wherein the push-button can bypass the float shut-off switch 40 to supply power from the on-off switch 80 to the pump motor 22. Accordingly, if the fluid level 15 rises during evacuation mode to a level such that causes the float shut-off switch 40 to open circuit, after placing the valve assembly in expulsion mode, the on-off switch can be activated while the bypass switch 82 is held down to activate the pump 22 to expel fluid from the tank until the fluid level drops sufficiently so that the float shut-off switch 40 is no longer open circuited.

In conclusion, herein is presented a system which selectively evacuates fluid into a storage tank, or expels fluid from said storage tank, as selected by the user.

What is claimed is:

1. A fluid evacuation and expulsion system, comprising:

a storage tank having a top and a bottom, defining an interior volume therebetween, having a tank port in communication with said interior volume;

a conduit connected to the tank bottom so as to be in fluid communication with the interior volume of the tank;

a pump having a pump inlet and a pump outlet;

a valve assembly connected to the pump inlet, pump outlet, and tank port, for selectively entering an evacuation mode wherein air is pumped from the interior volume of the tank through the tank port to cause fluid to be drawn up into the tank through the conduit, and an expulsion mode wherein air is pumped into the interior volume of the tank to expel fluid from the tank through the conduit; and an environmental port, in communication with the valve assembly.

2. The fluid evacuation and expulsion system as recited in claim 1, wherein fluid within the tank exists at a fluid level between the top and bottom of the tank, wherein power is supplied to the pump through a float shut-off switch located at the tank top, and wherein the float shut-off open circuits so that said switch does not allow power to reach the pump when a predetermined fluid level within the tank has been reached.

3. The fluid evacuation and expulsion system as recited in claim 2, further comprising a push-button bypass switch for selectively supplying power to the pump when the float shut-off switch is open circuited so as to allow the pump to operate for expulsion of fluid after evacuation caused the fluid level to activate the float shut-off switch.

4. The fluid evacuation and expulsion system as recited in claim 3, wherein the tank bottom is conical, having a lowest point, and wherein the conduit is connected at the lowest point, so that all fluid within the tank can be expelled through the conduit.

5. The fluid evacuation and expulsion system as recited in claim 4, wherein the valve assembly has a valve actuation switch and further comprises four valves that are ganged to the actuation switch which allow the system to selectively enter the evacuation and expulsion modes by moving the valve actuation switch.

6. The fluid evacuation and expulsion system as recited in claim 5, wherein the four valves include a forward tank port valve and a forward environment port valve, wherein the forward tank port valve connects the tank port to the pump inlet and the forward environment port valve connects the pump outlet to the environment port when the system is in the evacuation mode.

7. The fluid evacuation and expulsion system as recited in claim 6, wherein the four valves include a reverse tank port valve and a reverse environment port valve, wherein the reverse tank port valve connects the tank port to the pump outlet and the reverse environment port valve connects the pump inlet to the environment port when the system is in expulsion mode.

8. The fluid evacuation and expulsion system as recited in claim 7, wherein the conduit has a conduit valve for selectively preventing fluid flow through the conduit.

9. The fluid evacuation and expulsion system as recited in claim 8, further comprising an instrument assembly in communication with the internal volume of the tank.

10. The fluid evacuation and expulsion system as recited in claim 9, wherein the instrument assembly further comprises a blow-off valve which selectively opens to relieve pressure within the tank when pressure within the internal volume of the tank exceeds a predetermined limit.

11. The fluid evacuation and expulsion system as recited in claim 10, wherein the instrument assembly further comprises a pressure gauge and a vacuum gauge, for displaying positive pressures during the expulsion mode, and for displaying negative pressures during the evacuation mode.

* * * * *